US005437340A

United States Patent [19]

Lee et al.

[11] Patent Number: 5,437,340

[45] Date of Patent: Aug. 1, 1995

[54] MILLOUT WHIPSTOCK APPARATUS AND METHOD

[75] Inventors: Richard B. Lee, Spring; John W. Brandon, Kingwood, both of Tex.

[73] Assignee: Hunting MCS, Inc., Houston, Tex.

[21] Appl. No.: 264,684

[22] Filed: Jun. 23, 1994

[51] Int. Cl.[6] ..... E21B 7/08

[52] U.S. Cl. ..... 175/61; 166/117.6; 166/382; 175/80; 175/81

[58] Field of Search ..... 166/117.6, 117.5, 382; 175/61, 79–83

[56] References Cited

U.S. PATENT DOCUMENTS

| | | | |
|---|---|---|---|
| 1,835,227 | 12/1931 | Lane et al. | 166/117.6 |
| 1,851,319 | 3/1932 | McCoy et al. | 166/117.5 X |
| 1,901,453 | 3/1933 | Kelly | 166/117.5 |
| 2,338,788 | 1/1944 | Walker | 166/117.6 |
| 2,509,144 | 5/1950 | Gable et al. | 166/117.6 X |
| 3,908,759 | 9/1975 | Cagle et al. | 166/117.6 |
| 4,153,109 | 5/1979 | Szescila | 166/250 |
| 4,266,621 | 5/1981 | Brock | 175/329 |
| 4,285,399 | 8/1981 | Holland et al. | 166/117.6 X |
| 4,304,299 | 12/1981 | Holland et al. | 166/255 |
| 4,397,355 | 8/1983 | McLamore | 166/297 |
| 4,765,404 | 8/1988 | Bailey et al. | 166/117.6 |
| 5,113,938 | 5/1992 | Clayton | 166/117.6 |
| 5,154,231 | 10/1992 | Bailey et al. | 166/117.6 X |
| 5,318,132 | 6/1994 | Odorisio | 166/382 |

FOREIGN PATENT DOCUMENTS

| | | | |
|---|---|---|---|
| 1089223 | 4/1985 | U.S.S.R. | 175/81 |

*Primary Examiner*—Hoang C. Dang
*Attorney, Agent, or Firm*—Kenneth A. Roddy

[57] ABSTRACT

A millout whipstock has a cylindrical body with a stabbing nose at the bottom and a deflection shoe at the top. A drill string extending through the deflection shoe is connected to a pressure housing keyed in a torque key housing in the body. A piston, mounted in a piston housing secured in the body beneath the pressure housing, has an upper portion extending through the pressure housing and is pinned in a raised position by shear pins. A slip expander at the bottom of the piston engages slips supported adjacent openings in the side wall of the body. A fluid path extending through the drill string, pressure housing, piston housing, and piston, is closed off by a rupture disk. The body is lowered by the drill string onto a cement plug in the casing. The slips are set by applying fluid pressure in the drill string to shear the shear pins and force the piston and expander downward wedging the slips outward to grip the casing. The body is cemented in the casing by pumping cement down the drill string which bursts the rupture disk and flows to the exterior of the piston and through the bottom of the body filling the space around the stabbing nose and the interior of the body surrounding the expander assembly and lower portion of the piston. The drill string is removed and a window is cut through the side of the casing by a mill.

17 Claims, 4 Drawing Sheets

MILLOUT WHIPSTOCK APPARATUS AND METHOD

BACKGROUND OF THE INVENTION

1. Field of the Invention

This invention relates generally to whipstocks, and more particularly to a millout whipstock apparatus and method wherein the whipstock is lowered on a drill string, secured inside the casing by slips, and then cemented in place inside the casing to laterally deflect a motorized side cutter mill assembly for cutting a window in the casing.

2. Brief Description of the Prior Art

In the drilling of wells, such as oil and gas wells, wherein casing is set in the well bore, obstructions and blockages are often encountered which interfere with the production or further drilling of the well. In such cases, it is sometimes necessary or desirable to deflect the drilling tool angularly to pass around the blockage or obstruction, and reorient the hole. This is usually accomplished by installing a "whipstock" in the casing which is a guide element having a longitudinally tapered, upwardly facing, arcuate face or deflecting surface. A casing mill is then run down inside the casing and when it contacts the deflecting surface, the mill is deflected laterally at an angle to cut a hole or window through the side wall of the casing so that drilling may be continued through a new bore which is directed downwardly and laterally.

Special anchoring systems and packers have been employed for mounting the whipstock in the casing. There are several patents which disclose various whipstock anchoring systems and packers.

Cagle et al, U.S. Pat. No. 3,908,759 discloses a whipstock installation wherein a modified bridge plug having a splined latch-up device at its upper end is first set by wireline in the casing. A starter drill bit at the bottom of the drill string is connected to the top end of a whipstock by a shear pin and the whipstock has a mating splined latch-up device at its bottom end. The whipstock is lowered to connect it to the bridge plug. The splined latch-up prevents the whipstock from turning or moving up the hole. The starter drill bit is released by the weight of the drill string shearing the shear pin, and when released, the starter drill bit mills a window through the casing. The starter drill bit is then replaced by a larger diamond drill bit.

Szescila, U.S. Pat. No. 4,153,109 discloses a whipstock installation wherein a bridge plug or packer having slips and an orienting device is first run downhole on a setting tool. The slips are set hydraulically by a tandem cylinder and piston arrangement. The setting tool is removed, and then the whipstock connected by a shear bolt on another setting tool is run downhole and anchored to the bridge plug or packer and the bolt is sheared by an upward pull. A drill bit is then lowered downhole to mill a window through the casing.

Brock, U.S. Pat. No. 4,266,621 discloses a milling cutter which is used with a whipstock. The whipstock is landed on a cement plug and has a slip type anchor means which grip the casing. No details of the anchor means or method are discussed or shown. To enhance the cutting action, the milling cutter is structured such that the bit cannot rotate in a dead center position.

Holland et al, U.S. Pat. Nos. 4,285,399 and 4,304,299 disclose a whipstock installation wherein a bridge plug or packer having slips and orienting keys is run downhole on a setting tool. The slips are set by opposing upward and downward forces, or hydraulically. The setting tool is removed, and a surveying instrument is lowered to determine the orientation of the keys. Then the whipstock is run down and anchored to the bridge plug or packer. A drill bit is then lowered downhole to mill a window through the casing.

McLamore, U.S. Pat. No. 4,397,355 discloses a whipstock setting apparatus which includes a whipstock having an anchor packer connected on its lower end and a cutter assembly connected at its upper end. The assembly has a fluid line connecting the bore of the cutter to the anchor packer for setting the packer. The assembly is lowered as a unit on the drill string and set by pressuring the drill string without having to make a round trip. The packer has opposed slips which are set by pressuring the drill string which opens a check valve and moves a piston/mandrel downward to expand the slips. The drill string and cutter are released by rotating the string to shear the connection with the whipstock which also severs the fluid line and the cutter mills a window through the casing. When the fluid line is severed, the check valve closes to maintain pressure in the packer and the vertically opposed slips prevent longitudinal movement of the whipstock.

Bailey et al, U.S. Pat. No. 4,765,404 discloses a whipstock setting method and apparatus which includes a whipstock having a packer connected on its lower end and a cutter assembly connected at its upper end. The assembly has a fluid line connecting the bore of the cutter to the anchor packer for setting the packer. The assembly is lowered as a unit on the drill string and set by pressuring the drill string without having to make a round trip. The packer has opposed slips which are set by pressuring the drill string which moves a piston/mandrel downward to expand the slips and has a lock nut which interacts with the mandrel to maintain the set position of the slips. The drill string and cutter are released by rotating the string to shear the connection with the whipstock which also severs the fluid line and the cutter mills a window through the casing. When the fluid line is severed, the lock nut maintains compression on the packing assembly and the vertically opposed slips prevent longitudinal movement of the whipstock.

The present invention is distinguished over the prior art in general, and these patents in particular by a millout whipstock having a cylindrical body with a stabbing nose at the bottom and an angular deflection shoe at the top. A drill string extends through the deflection shoe and is connected to a pressure housing keyed in a slotted torque key housing secured in the body. A piston housing is secured in the body beneath the pressure housing. A piston mounted in the piston housing has an upper portion extending through the pressure housing and is pinned in a raised position by shear pins. A slip expander having angled outer surfaces is connected to the bottom of the piston. Slips supported adjacent openings in the side wall of the body have an angled slot engageable with the expander angled surfaces. A fluid path extends through the drill string, pressure housing, piston housing, and piston, and is closed off by a rupture disk. The body is lowered by the drill string onto a cement plug in the casing. The slips are set by applying fluid pressure in the drill string to shear the shear pins and force the piston and expander downward to wedge the slips outward to grip the casing interior. The body is cemented in the casing by pumping cement down the drill string which bursts the rupture disk and flows to the exterior of the piston and through the bottom of the body filling the space around the stabbing nose and the interior of the body surrounding the expander assembly and lower portion of the piston. The drill string is then removed and a window is cut through the side of the casing by a mill.

SUMMARY OF THE INVENTION

It is therefore an object of the present invention to provide a millout whipstock apparatus and method wherein the whipstock is lowered on a drill string, secured inside the casing by slips, and then cemented in place inside the casing to laterally deflect a motorized side cutter mill assembly for cutting a window in the casing.

It is another object of this invention to provide a millout whipstock apparatus and method which eliminates the separate trip of the drill string for setting the slips of the whipstock apparatus.

Another object of this invention is to provide a millout whipstock apparatus and method wherein the whipstock apparatus is lowered as a single unit on the drill string.

Another object of this invention is to provide a millout whipstock apparatus and method wherein the slips of the whipstock are set by pressuring the drill string.

Another object of this invention is to provide a millout whipstock apparatus and method wherein the slips of the whipstock are set by pressuring the drill string and after being set, the whipstock is cemented in the casing of the well bore by pumping cement down the drill string.

A further object of this invention is to provide a millout whipstock apparatus which is easily and quickly run, oriented, and set in the casing of a well bore.

A still further object of this invention is to provide a millout whipstock apparatus which is simple in construction, economical to manufacture and reliable in operation.

Other objects of the invention will become apparent from time to time throughout the specification and claims as hereinafter related.

The above noted objects and other objects of the invention are accomplished by a millout whipstock having a cylindrical body with a stabbing nose at the bottom and an angular deflection shoe at the top. A drill string extends through the deflection shoe and is connected to a pressure housing keyed in a slotted torque key housing secured in the body. A piston housing is secured in the body beneath the pressure housing. A piston mounted in the piston housing has an upper portion extending through the pressure housing and is pinned in a raised position by shear pins. A slip expander having angled outer surfaces is connected to the bottom of the piston. Slips supported adjacent openings in the side wall of the body have an angled slot engageable with the expander angled surfaces. A fluid path extends through the drill string, pressure housing, piston housing, and piston, and is closed off by a rupture disk. The body is lowered by the drill string onto a cement plug in the casing. The slips are set by applying fluid pressure in the drill string to shear the shear pins and force the piston and expander downward to wedge the slips outward to grip the casing interior. The body is cemented in the casing by pumping cement down the drill string which bursts the rupture disk and flows to the exterior of the piston and through the bottom of the body filling the space around the stabbing nose and the interior of the body surrounding the expander assembly and lower portion of the piston. The drill string is then removed and a window is cut through the side of the casing by a mill.

DESCRIPTION OF THE PREFERRED EMBODIMENT

Figure 1A:
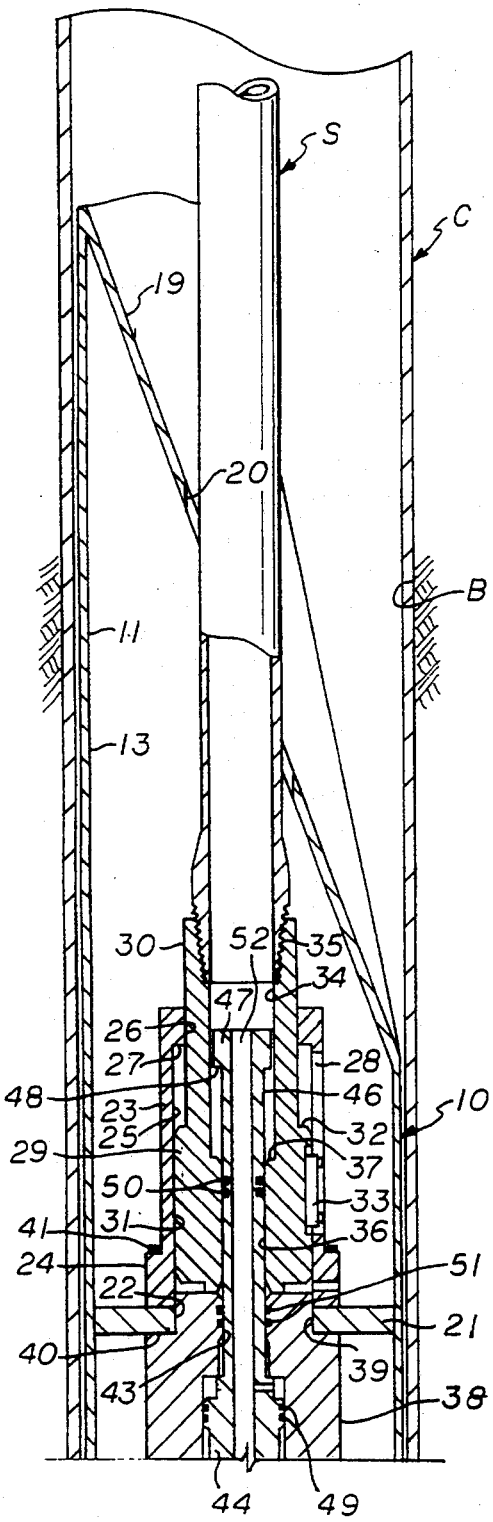
FIGS. 1A and 1B taken together are a longitudinal cross section showing the details of construction of a preferred millout whipstock apparatus in accordance with the present invention.

Referring to the drawings by numerals of reference, there is shown in FIG. 1, well casing C disposed in a well bore B, and a preferred millout whipstock apparatus 10 being deployed to land on a cement plug P in the casing.

The millout whipstock apparatus 10 has a hollow cylindrical outer housing 11 with a bottom wall 12 at the bottom end and an elongate side wall 13 extending upwardly from the bottom wall. A stabbing nose 14 is secured to the bottom wall 12. The stabbing nose 14 has a cross-shaped transverse cross section formed of flat plates 15 welded together which extend radially outward from a common center. The top edges of the plates 15 are welded to the bottom wall 12 of the outer housing 11 and the outer edges 16 of the plates extend downward and angularly inward from the bottom wall 12 to serve as a guide surface for guiding the apparatus into the casing C. A flat circular plate 17 is welded to the bottom edges of the plates 15. A series of holes 18 extend through the bottom wall 12 between the plates 15 of the stabbing nose 14.

The upper end of side wall 13 of the outer housing 11 is cut at an angle and an inwardly curved plate is welded to the top end of the angularly cut upper end of the side wall to form a downwardly and angularly disposed deflection shoe 19. The deflection shoe plate 19 is formed of hardened steel and contoured to laterally deflect a non-rotating stabilizer member of a motorized side cutter mill assembly used to cut a window in the casing C (described hereinafter). A hole 20 extends through the curved deflection shoe plate 19 at the center of the longitudinal axis of the outer housing 11.

A circular plate 21 having a central bore 22 is secured horizontally inside the outer housing 11 intermediate its top and bottom ends. A hollow cylindrical torque key housing 23 having an enlarged diameter radial flange 24 at its bottom end is secured to the top surface of the plate 21 and extends a distance upwardly therefrom. The interior of the torque key housing 23 has first central bore 25 extending upwardly from the bottom end and terminating in a reduced diameter bore 26 at its top end defining a radial shoulder 27 therebetween. A longitudinal key slot 28 is formed in the side wall of the torque key housing 23.

A cylindrical keyed pressure housing 29 having a reduced diameter upper portion 30 and a larger diameter lower portion 31 defining a radial shoulder 32 therebetween is slidably mounted in the torque key housing 23 with the reduced diameter portion 30 extending upwardly through the bore 26 at the top end of the torque key housing. A square key 33 bolted to the exterior of the larger diameter lower portion 31 of the pressure housing 29 extends outwardly therefrom and is slidably received in the key slot 28. The interior of the pressure housing 29 has a central bore 34 with internal threads 35 at the top end for receiving the threaded end of a drill pipe S and a reduced diameter bore 36 at the bottom end defining a radial shoulder 37 therebetween.

A cylindrical piston housing 38 is secured to the plate 21 and extends a distance downwardly therefrom. The exterior of the piston housing 38 has a reduced diameter top portion 39 which is received through the central bore 22 of the plate 21 and a short distance into the central bore 31 of the torque key housing 23 and defines a radial shoulder 40 which engages the bottom surface of the plate 21.

The torque key housing 23 and the piston housing 38 are secured to the plate 21 by bolts 41 which extend through bolt holes in the flange 24 and plate 21 and are threadedly engaged in threaded holes in the shoulder 40 of the piston housing 38 (not shown).

The interior of the piston housing 38 has a central bore 42 extending upwardly from its bottom end and terminating in a reduced diameter bore 43 at its top end. An elongate tubular slip setting piston 44 is slidably mounted in the bore 42 of the piston housing 38 and has a first diameter lower portion 45 extending downwardly therefrom and a reduced diameter upper portion 46 which extends upwardly through the reduced bore 43 of the piston housing 38 and the reduced bore 36 of the keyed pressure housing 29 and terminates in a larger diameter portion 47 at its top end defining a downward facing radial shoulder 48. Seals 49, 50, and 51 are provided on the exterior of the slip setting piston 44 and on the reduced diameter bore 43 of the piston housing 38, respectively, to provide a fluid sealing relation between the relatively movable members. The interior of the slip setting piston 44 has a central bore 52 extending downward a distance from its top end and terminates a short distance from its bottom end.

Shear pins 53 extend radially inwardly through the bottom portion of the piston housing 38 and into the side wall of the lower portion 45 of the slip setting piston 44 to secure the slip setting piston to the piston housing in the deployment condition. A cement rupture disk 54 is secured to the side wall of the lower portion 45 of the slip setting piston 44 in fluid communication with the central bore 52. A slot 55 extends transversely across the bottom end of the slip setting piston 44.

Figure 1B:
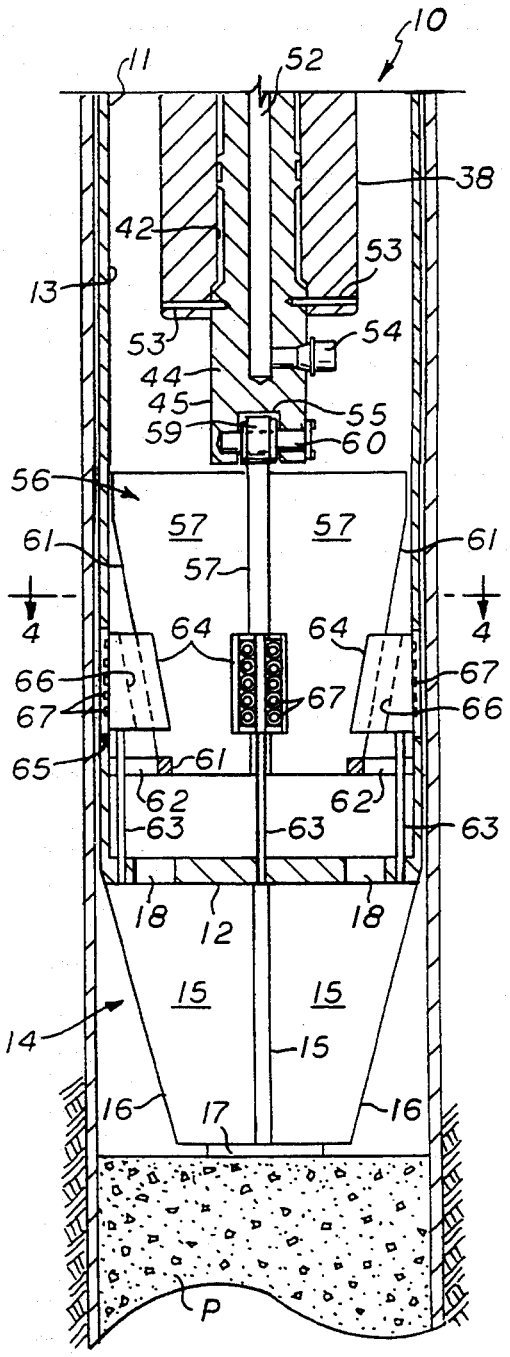
Figure 4:
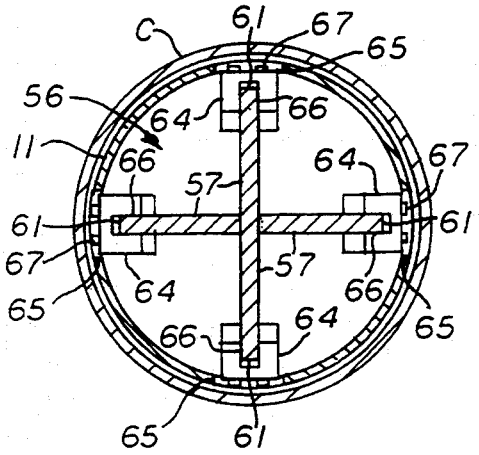
FIG. 4 is a transverse cross section through the slip assembly taken along line 4—4 of FIG. 1B.

As best seen in FIGS. 1B and 4, a slip expander 56 is pivotally attached to the bottom end of the slip setting piston 44. The slip expander 56 has a cross-shaped transverse cross section formed of flat plates 57 welded together to extend radially outward from the longitudinal axis. The top end 59 of one flat plate 57 is slidably received in the transverse slot 55 at the bottom end of the slip setting piston 44 and is pivotally secured therein by a pivot pin 60. The outer edges 61 of the plates 57 extend downward and angularly inward to serve as an angled slip engaging surface. A flat circular plate 61 is welded to the bottom edges of the plates 57 and has a series of slots 62 extending radially inwardly in axial alignment with the plates.

A series of small diameter slip support rods 63 have their bottom ends secured in the bottom wall 12 of the outer housing 11 and extend vertically upward therefrom. A rectangular slip member 64 is secured to the top end of each support rod 63. A series of rectangular openings 65 are provided through the side wall 13 of the outer housing 11 and the slips 64 are disposed inwardly adjacent each opening. Each slip 64 has an angular slot 66 in its inward facing surface which receives the outer facing angled edge 61 of one of the plates 57 of the expander 56. In the deployment position, the slips 64 are maintained in a retracted position within the openings 65 by the rods 63 and when the expander assembly moves vertically downward relative to the slips, the angled surfaces 61 of the expander plates 57 ride downwardly in the angled slots 66 and wedge the slips radially outward of the openings 65 to grip the interior surface of the casing C. A series of small carbide or case hardened inserts 67 may be secured to the outer surface of the slips 64 to increase friction and facilitate gripping the interior of the casing.

OPERATION

Prior to installing the millout whipstock in the casing C, the interior of the casing is cemented in, and after curing, the top end of the cement plug P is milled flat by conventional methods.

Figure 2:
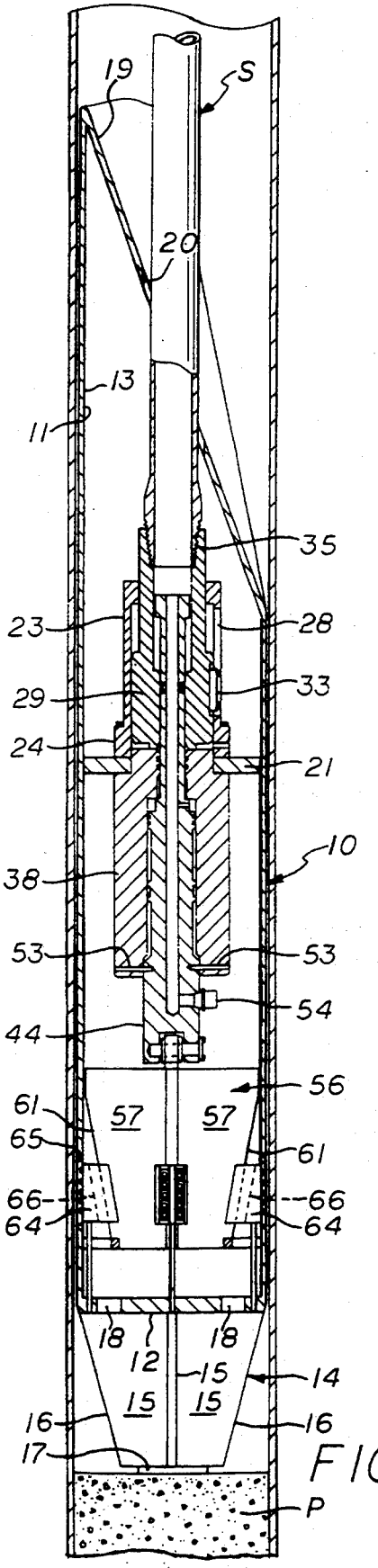
FIG. 2 is a longitudinal cross section of the millout whipstock apparatus shown inside a casing of a well bore prior to setting the slips.

As seen in FIGS. 1A, 1B, and 2, the millout whipstock apparatus 10 is connected to the bottom end of the drill string S by inserting the bottom end of the drill string S through the hole 20 in the deflection shoe 19 and engaging the threaded end of the drill string in the internal threads 35 of the keyed pressure housing 29. The threaded connection is torqued to 10,000 ft/lbs of torque. In the deployment position, the slip setting piston 44 is locked in the raised position by the shear pins 53 and the slips 64 are in the retracted position. The millout whipstock apparatus 10 is lowered by the drill string S as a single unit until the plate 17 at the bottom of the stabbing nose 14 contacts the milled top surface of the cement plug P.

After the stabbing nose 14 is resting on the cement plug P, the apparatus 10 may be rotated for proper orientation with respect to the casing C to properly position the deflection shoe 19 for laterally deflecting a non-rotating stabilizer member of a motorized side cutter mill assembly which will be used to cut a window in the casing C. Proper orientation of the deflection shoe is verified by methods conventional in the art.

Figure 3:
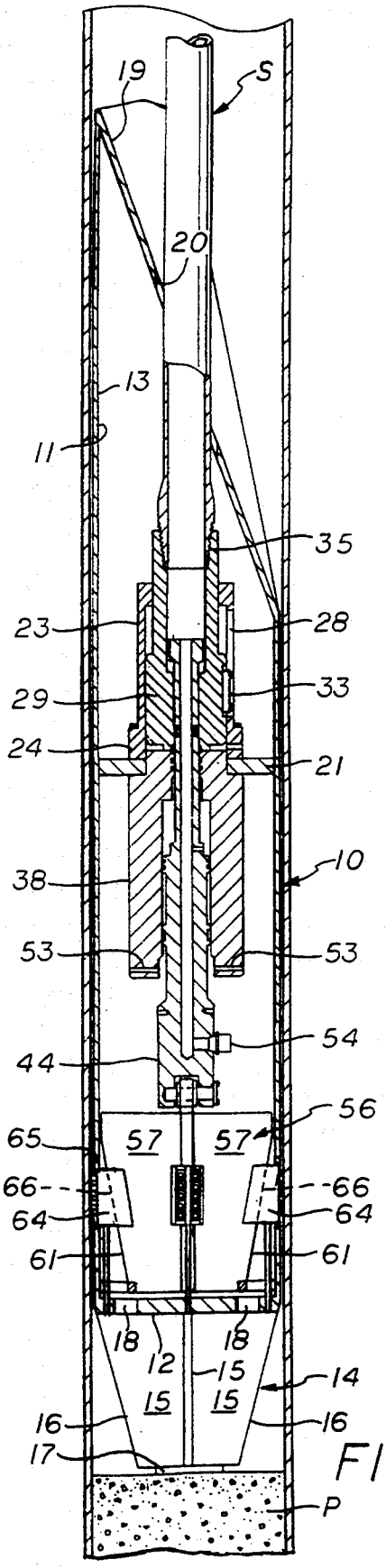
FIG. 3 is a longitudinal cross section of the millout whipstock apparatus shown in a position with the slips set inside the casing.

Referring now to FIG. 3, after proper orientation of the deflection shoe 19 has been verified, the slips 64 are set by applying fluid pressure to the interior of the drill string S. When the pressure in the drill string reaches about 500 psi, downward force on the slip setting piston 44 will shear the shear pins 53 and the slip setting piston will move downward relative to the piston housing 38.

As the slip setting piston 44 moves downward, the expander assembly 56 connected at its bottom end moves vertically downward relative to the slips 64 and the angled surfaces 61 of the expander plates 57 engage and ride down on the angled slots 66 of the slips to force the slips radially outward of the openings 65 in the side wall 13 of the outer housing 11 to engage and firmly grip the interior surface of the casing C. The small carbide or case hardened inserts 67 on the outer surface of the slips 64 increase friction and facilitate gripping the interior surface of the casing to prevent relative rotation.

Figure 5:
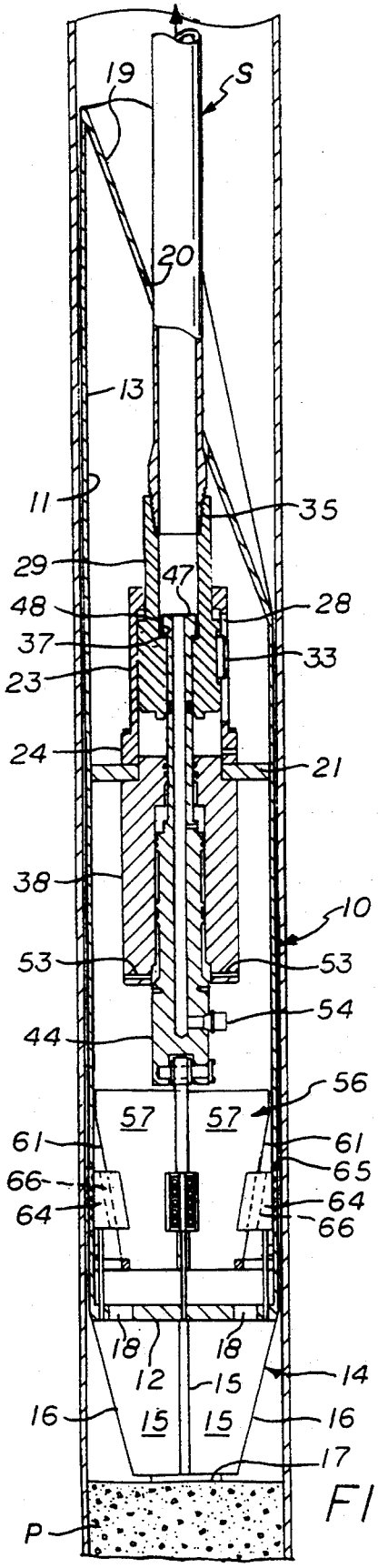
FIG. 5 is a longitudinal cross section of the millout whipstock apparatus shown after the shear pins have been sheared and the slips being reset by lifting the drill string.

As seen in FIG. 5, to release and reset the slips 64, the pressure in the drill string S is shut off and the drill string is pulled upwardly which pulls the keyed pressure housing 29 upwardly until its radial shoulder 37 engages the radial shoulder 48 near the top end 47 of the slip setting piston 44. Continued upward movement of the drill string S and keyed pressure housing 29 causes the slip setting piston 44 and expander assembly 56 to move upwardly and disengage the tapered surfaces 61 and 66 of the expander plates 57 and slips 64, thus releasing the outward force on the slips and allowing them to retract inwardly.

The slips 64 can be reset by once again applying fluid pressure to the interior of the drill string S to move the slip setting piston 44 and expander assembly 56 downward relative to the piston housing 38.

Figure 6:
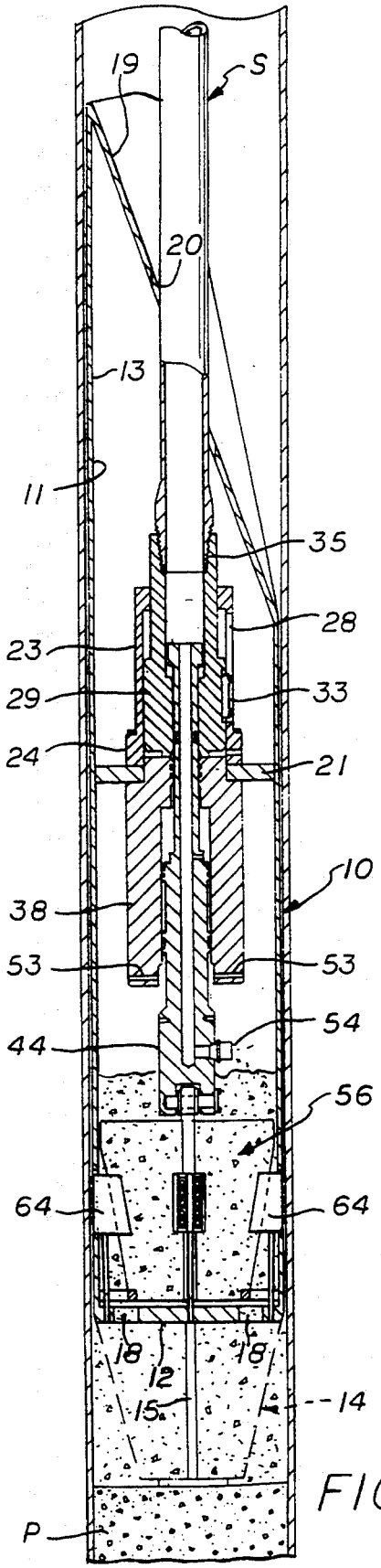
FIG. 6 is a longitudinal cross section of the millout whipstock apparatus shown being cemented inside the casing.

A shown in FIG. 6, after the deflection shoe 19 has been properly positioned and the slips 64 have been set, the millout whipstock apparatus 10 is cemented in the casing C by pumping cement down the drill string S at a pressure of about 1500 psi which will burst the rupture disk 54 and create a cement flow passageway through the drill string to the interior of the outer housing 11. Cement is pumped through the drill string to flow through the holes 18 in the bottom wall 12 of the outer housing 11 to fill the open spaces around the stabbing nose 14 and the interior of the outer housing surrounding the expander assembly 56 and lower portion of the slip setting piston 44.

The drill string S is then rotated to disengage the threaded connection and it is removed from the well bore, leaving the millout whipstock cemented in the casing.

Figure 7:
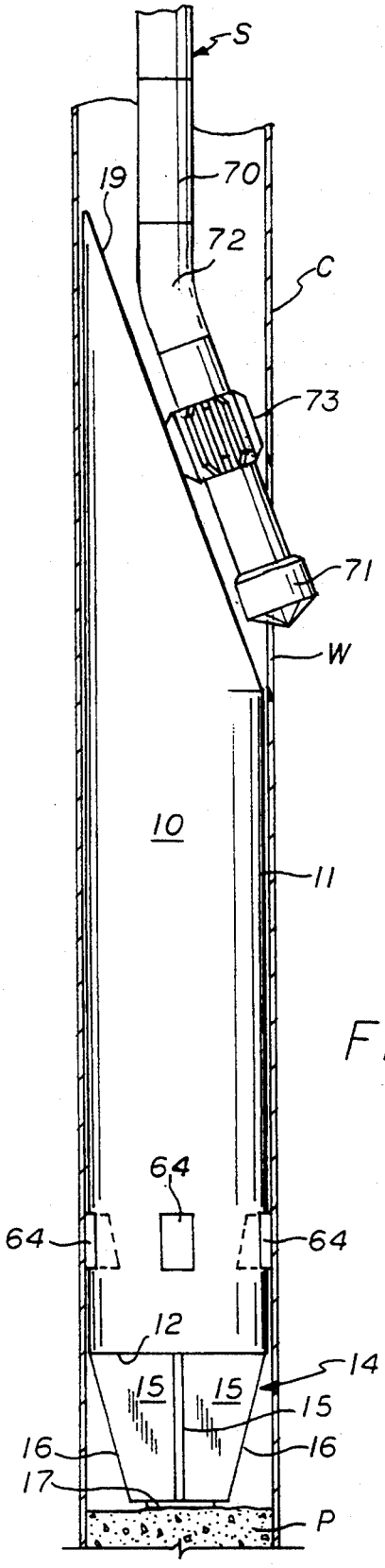
FIG. 7 is a schematic side elevation showing a window being cut in the side wall of the casing, using the millout whipstock in accordance with the present invention.

As shown schematically in FIG. 7, a window W may be milled in the side wall of the casing C by a mud motor 70 driving a rotating side cutter mill 71 through a bent sub 72. A non-rotating stabilizer 73 is secured in the milling string above the mill 71 such that only the non-rotating stabilizer 73 and not the side cutter mill contacts the curved surface of the deflection shoe plate 19. The deflection shoe plate 19 laterally deflects the non-rotating stabilizer 73 while the side cutter mill 71 cuts a window W in the casing C.

While this invention has been described fully and completely with special emphasis upon a preferred embodiment, it should be understood that within the scope of the appended claims the invention may be practiced otherwise than has been specifically described herein.

What is claimed is:

1. A whipstock apparatus for installation in a casing of a well bore comprising:

a cylindrical body having a concave longitudinally tapered upwardly facing tool deflecting surface at an upper end and apertures through a lower end;

an aperture in said tool deflecting surface through which the lower end of a drill string passes;

drill string connection means in said cylindrical body for releasable connection to said drill string lower end;

a piston in said cylindrical body slidably mounted in said drill string connection means for longitudinal movement relative to said cylindrical body and said drill string connection means;

a fluid passage extending through said drill string, said drill string connection means, and said piston;

a rupture disk mounted in said fluid passage of said piston to close off said fluid passage and prevent fluid communication between the interior and exterior of said piston and effect longitudinal movement thereof upon fluid pressure of a first magnitude in said fluid passage;

gripping means adjacent said apertures in said cylindrical body lower end connected with said piston for lateral extension outwardly from the circumference of said cylindrical body to engage the interior surface of said casing upon longitudinal movement of said piston in one direction and for retraction inwardly from the circumference of said cylindrical body upon longitudinal movement of said piston in another direction, said gripping means in the extended position preventing relative movement between said cylindrical body and said casing and in the retracted position allowing relative movement therebetween; and said cylindrical body is anchored in said casing with said gripping means secured in the engaged condition against the interior surface of said casing by pumping cement through said fluid passageway at a fluid pressure of a second magnitude sufficiently greater than said first magnitude to burst said rupture disk and flow through said drill string, said drill string connection means, said piston, through said rupture disk to the exterior of said piston, and through said apertures in said cylindrical body lower end.

2. The whipstock apparatus according to claim 1 including an expansion member connected with said piston to move therewith, said expansion member having a tapered surface, and said gripping means comprises slip members movably disposed in said cylindrical body adjacent circumferentially spaced openings in the side wall of said cylindrical body and having a surface engageable with said expansion member tapered surface to wedge said slip members to the extended position.

3. The whipstock apparatus according to claim 1 including a stabbing nose secured at a bottom end of said cylindrical body having outer edges extending downward and angularly inward from said bottom end to serve as a guide surface for guiding said cylindrical body into said casing.

4. The whipstock apparatus according to claim 1 in which said drill string connection means and said piston are connected together to allow relative longitudinal movement and said piston is captured by said drill string connection means to allow said piston member to be moved longitudinally by said drill string in said another direction to allow retraction of said gripping means inwardly from the circumference of said cylindrical body.

5. The whipstock apparatus according to claim 1 in which said drill string connection means and said piston are pinned together by a shear pin which is sheared upon fluid pressure of a first magnitude in said fluid passage to allow relative longitudinal movement therebetween and said piston is captured by said drill string connection means to allow said piston to be moved longitudinally by said drill string in said another direction to allow retraction of said gripping means inwardly from the circumference of said cylindrical body.

6. The whipstock apparatus according to claim 5 in which said shear pin is sheared upon fluid pressure of approximately 500 psi in said fluid passage.

7. The whipstock apparatus according to claim 1 in which said rupture disk is ruptured upon fluid pressure of approximately 1500 psi in said fluid passage.

8. A whipstock apparatus for installation in a casing of a well bore comprising:

a cylindrical body having a concave longitudinally tapered upwardly facing tool deflecting surface at an upper end and an aperture in said tool deflecting surface through which the threaded lower end of a drill string passes;

drill string connection means in said cylindrical body for releasable threaded connection to said drill string threaded lower end, said drill string connection means keyed in said cylindrical body to prevent rotation of said drill string connection means when making or breaking the threaded connection between said drill string threaded lower end and said drill string connection means;

a piston in said cylindrical body slidably mounted in said drill string connection means for longitudinal movement relative to said cylindrical body and said drill string connection means;

a fluid passage extending through said drill string and said drill string connection means and in fluid communication with said piston to effect longitudinal movement thereof upon fluid pressure of a first magnitude in said fluid passage; and gripping means in said cylindrical body connected with said piston for lateral extension outwardly from the circumference of said cylindrical body to engage the interior surface of said casing upon longitudinal movement of said piston in one direction and for retraction inwardly from the circumference of said cylindrical body upon longitudinal movement of said piston in another direction, said gripping means in the extended position preventing relative movement between said cylindrical body and said casing and in the retracted position allowing relative movement therebetween.

9. The whipstock apparatus according to claim 8 in which said drill string connection means comprises a hollow cylindrical torque key housing secured in said cylindrical body and having a longitudinal key slot in its side wall, a cylindrical pressure housing having a central bore with interior threads at an upper end to threadedly engage said drill string threaded lower end, said pressure housing slidably mounted in said torque key housing for longitudinal movement relative thereto, and a key secured to the exterior of said pressure housing extending laterally outwardly therefrom and slidably received in said key slot to prevent rotation of said pressure housing relative to said torque key housing and said cylindrical body.

10. The whipstock apparatus according to claim 9 including a cylindrical piston housing secured in said cylindrical body beneath said pressure housing and having a central bore coaxial with said pressure housing central bore, said piston having a lower portion slidably mounted in said piston housing central bore and a reduced diameter upper portion which extends upwardly therefrom through said pressure housing central bore, and seal means between the exterior of said piston lower portion and said piston housing central bore and between said piston upper portion and said pressure housing central bore, to provide a fluid sealing relation therebetween.

11. The whipstock apparatus according to claim 10 including a shear pin extending between said piston housing and the exterior of said piston to secure said piston to said piston housing, and said shear pin being sheared upon fluid pressure of a first magnitude in said fluid passage to allow relative longitudinal movement therebetween to allow said piston to be moved longitudinally by said drill string in said another direction to allow retraction of said gripping means inwardly from the circumference of said cylindrical body.

12. The whipstock apparatus according to claim 11 in which said piston has a central bore extending downwardly from said upper portion and terminating in said lower portion, and a lateral passageway extending therefrom to the exterior of said piston, a rupture disk in said lateral passageway preventing fluid communication between said piston central bore and said exterior when subjected to said fluid pressure of a first magnitude;

said cylindrical body has apertures through a lower end adjacent said gripping means; and cement is pumped through said fluid passage at a fluid pressure of a second magnitude greater than said first magnitude to burst said rupture disk and flow through said drill string, said pressure housing central bore, and said piston central bore, through said rupture disk to the exterior of said piston, and through said apertures in said cylindrical body lower end; such that said cylindrical body is anchored in said casing with said gripping means secured in the engaged condition against the interior surface of said casing by the cement.

13. The whipstock apparatus according to claim 12 in which said shear pin is sheared upon fluid pressure of approximately 500 psi in said fluid passage, and said rupture disk is ruptured upon fluid pressure of approximately 1500 psi in said fluid passage.

14. The whipstock apparatus according to claim 12 including an expansion member connected with said piston to move therewith, said expansion member having a tapered surface, and said gripping means comprises slip members movably disposed in said cylindrical body adjacent circumferentially spaced openings in the side wall of said cylindrical body and having a surface engageable with said expansion member tapered surface to wedge said slip members to the extended position.

15. The whipstock apparatus according to claim 14 including a stabbing nose secured at a bottom end of said cylindrical body having outer edges extending downward and angularly inward from said bottom end to serve as a guide surface for guiding said cylindrical body into said casing.

16. A method of setting a millout whipstock in the casing of a well bore for changing the direction of drilling comprising the steps of;

connecting the lower end of a drill string to a millout whipstock having an angular deflection shoe at a top end and a radially expandable slip assembly at a lower end actuated by fluid pressure on a longitudinal piston which has a fluid passage closed off by a rupture disk, running the millout whipstock into the casing of the well bore to a desired level, determining the orientation of said millout whipstock deflection shoe, exerting a fluid pressure through said drill string at a first magnitude to move said piston and expand said slip assembly radially outward to engage the interior surface of said casing, pumping cement through said drill string at a fluid pressure of a second magnitude greater than said first magnitude to burst said rupture disk and flow through said drill string and through said piston to fill the spaces around said radially expandable slip assembly and the lower end of said millout whipstock to anchor said millout whipstock in said casing with said slip assembly in the engaged condition against the interior surface of said casing, removing said drill string from said millout whipstock, connecting a cutting mill assembly to the lower end of a drill string including a motor driving a rotating cutter mill through a bent sub and a non-rotating stabilizer member connected above the cutter mill, and running said cutting mill assembly into said casing such that only the non-rotating stabilizer and not the rotating cutter mill contacts said deflection shoe to laterally deflect the non-rotating stabilizer while the side cutter mill cuts a window in said casing to allow drilling of a new well bore.

17. The method according to claim 16 in which said longitudinal piston is pinned in said millout whipstock by a shear pin, and said step of exerting a fluid pressure through said drill string at a first magnitude comprises exerting a fluid pressure of approximately 500 psi through said drill string to shear said shear pin to move said piston and expand said slip assembly, and said step of pumping cement through said drill string at a fluid pressure of a second magnitude comprises pumping cement through said drill string at a fluid pressure of approximately 1500 psi to burst said rupture disk.

* * * * *